US007395869B2

(12) United States Patent
Schnabel et al.

(10) Patent No.: US 7,395,869 B2
(45) Date of Patent: Jul. 8, 2008

(54) EXTERNAL STRUCTURE FIRE PROTECTION SYSTEM "ESFPS"

(76) Inventors: Jens Schnabel, P.O. Box 1329, Camarillo, CA (US) 93011; Peter Lust, Jr., P.O. Box 1329, Camarillo, CA (US) 93011

( * ) Notice: Subject to any disclaimer, the term of this patent is extended or adjusted under 35 U.S.C. 154(b) by 257 days.

(21) Appl. No.: 11/145,338

(22) Filed: Jun. 2, 2005

(65) Prior Publication Data

US 2006/0083920 A1 Apr. 20, 2006

(51) Int. Cl.
*A62C 2/10* (2006.01)

(52) U.S. Cl. ..... 169/48; 52/3; 52/5; 135/90; 135/115; 135/119; 160/330

(58) Field of Classification Search ..... 169/48; 52/3, 5; 135/90, 115, 119; 160/330
See application file for complete search history.

(56) References Cited

U.S. PATENT DOCUMENTS 3,715,843 A * 2/1973 Ballinger ..... 52/3
3,877,525 A * 4/1975 Husson et al. ..... 169/48
4,858,395 A * 8/1989 McQuirk ..... 52/3
5,522,198 A * 6/1996 Byer et al. ..... 52/741.3
5,608,992 A * 3/1997 Floyd ..... 52/3
5,748,072 A * 5/1998 Wang ..... 340/286.05
5,829,200 A * 11/1998 Jones et al. ..... 52/3
6,125,941 A * 10/2000 Lokken ..... 169/50
6,742,305 B2 * 6/2004 Rogers et al. ..... 52/3
7,225,882 B2 * 6/2007 Miller et al. ..... 169/45

* cited by examiner

*Primary Examiner*—Andrew T Piziali

(57) ABSTRACT

A barrier system for protection and resistance from externally started fires, forest fires and other fires that effect and start a structure burning from the outside inward. The barrier system comprising a specifically designed track system mounted onto the top of the structure, utilizing fire protective material hanging down the sides of the structure to create a fire resistant enclosure. The barrier system is designed to be assembled and set up in advance on the structure in preparation of a fire. The barrier system design allows for ease and quickness with installation. Pre-installation of the barrier system on a roof of a structure that is being fire protected is provided by sectional pieces that are delivered to the structure and then installed in advance. The barrier system sectional pieces are designed to be different lengths and are adapted to the unique dimensions of the structure.

9 Claims, 3 Drawing Sheets

EXTERNAL STRUCTURE FIRE PROTECTION SYSTEM "ESFPS"

BACKGROUND OF INVENTION

Living in Southern California and seeing all the houses burning down, Ameba Inventions believes that a personally controlled system needs to be developed to reduce loss of home and private property and assist in control of insurance rates by offering lower risk to a structure owner in high fire areas.

DESCRIPTION OF ART

The various figures supplied FIGS. 1-3 show the aspects of the design and structure.

SUMMARY OF INVENTION

In Summary the ESFPS will help saves property, lives and private possessions by protecting the structure from fire at the structures most vulnerable stage

DESCRIPTION OF OPERATION

Figure 2A:
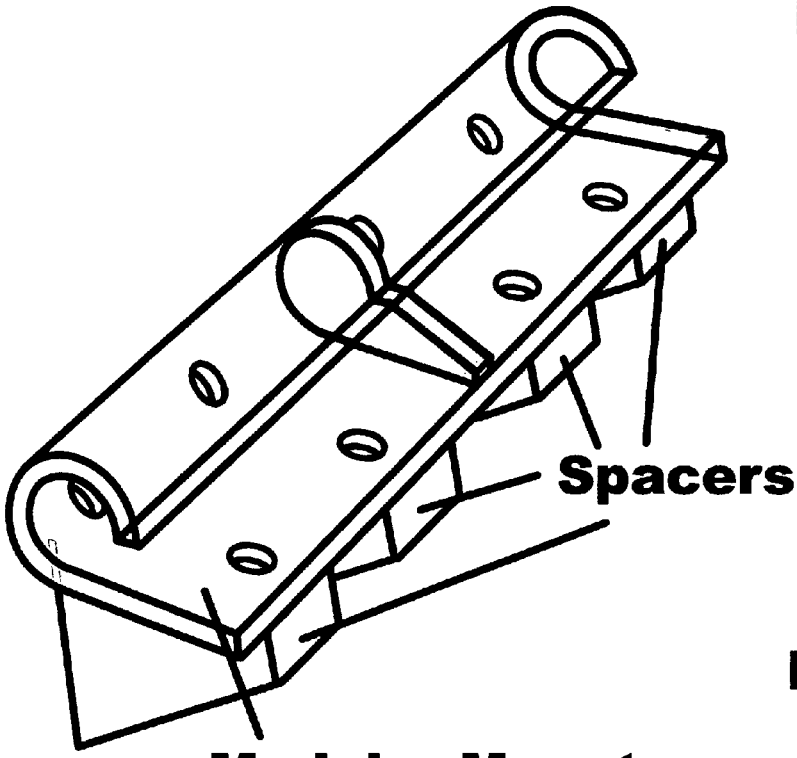

The Operation is achieved by protection and resistance from externally started fires, forest fires and other fires that effect and start a structure burning from the outside. Protecting the entire structure or house with specifically designed track system mounted onto the structure or house itself and utilizing fire protective material hanging down the sides of the structure. The "ESFPS" is designed to set up in advance on the structure in preparation of a fire on its way. Pre-installation of the mounting system on the top/roof of the structure that is being fire protected is required. This is achieved by initially reviewing the structure dimensions and then completing an assembly drawing in advance. The sectional materials are then delivered to the customer who in turn installs the "MODULAR MOUNTING SYSTEM" on the structure in advance. The "ESFPS" is designed as complete mounting system on the structure itself. It utilizes a specially designed molded, shaped and machined fixture system (FIG. 2*a,b*).

The second major area of the "ESFPS" is in the uniquely designed and modular fire resistant sections, made of fabric that is capable of resisting an extremely high temperature. These sections are rolled up for storage and stored in a long-term safe keeping storage container to allow for use with many years between.

When unwrapped the fire resistant fabric and internally designed holding fixtures with its fire resistant material are attached to the "MODULAR MOUNT" on the roof of the structure and then hang down the side of the structure. (FIGURE 1*a,b*) The "ESFPS" utilizes a secondary option mechanism of existing technology water sprinkler systems but attached in a unique way that compliments the fire protection ability of the "ESFPS". The materials used in the sprinkler system are also made and molded from high temperature composite and ceramic materials to insure that no melting can occur.

Interlocking Connections

The "ESFPS" utilizes a mechanism (FIG. 3) for attaching each section of the systems together. This is achieved by utilizing high temperature fabric adhesive material sewn into the fireproof fabric for attachment of different sections. The locations of the high temperature fabric adhesive are specifically decided in advance of the assembly of the overall "ESFPS".

Installation

The "ESFPS" operates independently once installed. The pre-installation of the tracks, which are mounted on the edge of the roof of the structure, which could be a house, home or building. The design allows for use with any reasonable size structure by being specially made to the specifications and dimensions of the structure it will protect. "ESFPS" claims uniqueness of concept and ornamental design of combining all the elements that in total achieve a mechanical design that allows for significant fire protection. The fire protection is achieved by a combination of fire protection material hanging down the sides of the structure and can be augmented with option external sprinkler systems pre-mounted on the roof parameter of the structure.

"Modular Mount"

The "MODULAR MOUNT" is constructed of sections in (example 4, 5 and 6 feet standard lengths. (FIG. 2*a, b*) The design of the mount is considered unique and molded from fire resistant composite style materials as well as machined metal such as aluminum alloy or steel for the purpose of hanging the fire prevention material. The design of the "MODULAR MOUNT" is such that it is capable of carrying a minimum of 3 times its weight in strength.

Figure 2B:
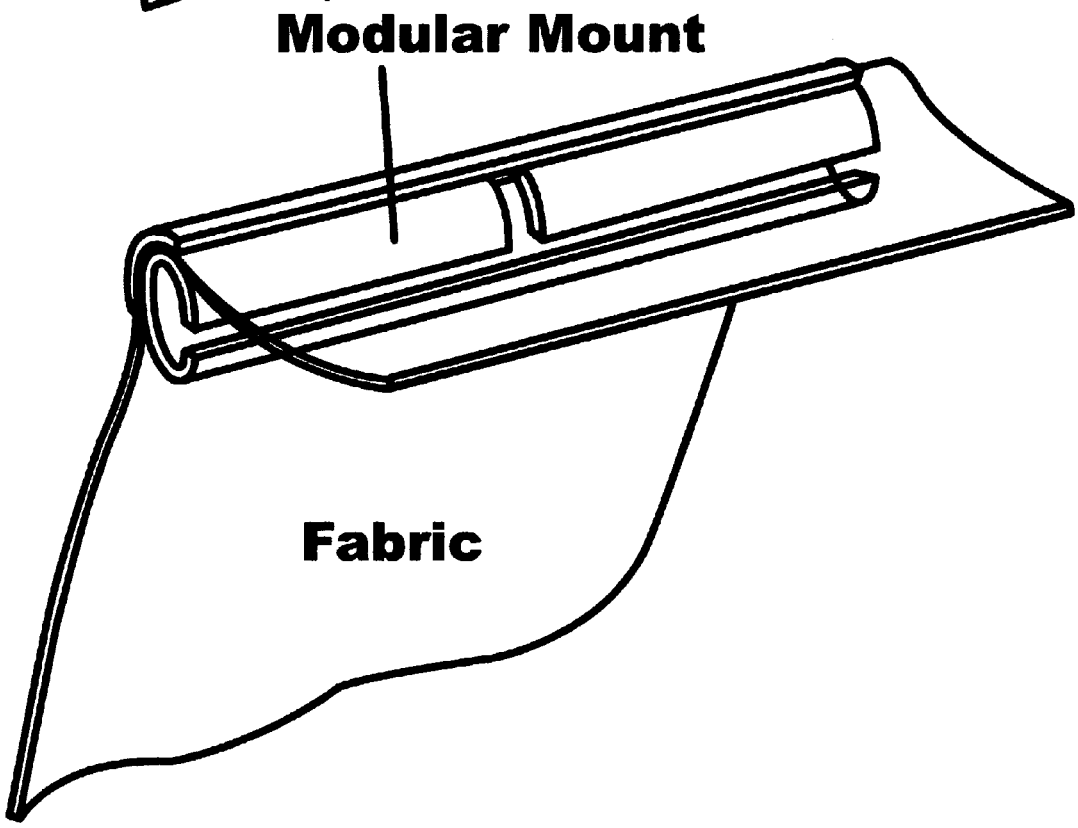

The internal construction of the "MODULAR MOUNT" utilizes a composite/ceramic and/or aluminum alloy/metal molded hanging feature as and claimed in this patent (FIG. 2*b*).

Anti Slip

An "ANTI-SLIP" feature that allows the overall "ESFPS" to hang in most any angles whilst maximizing the area protected by the fire resistant fibers are also claimed in this patent. The "MODULAR MOUNT" consists of 2 separated molded units that have a "HOOK AND HOLD" system, which prevents the "MODULAR MOUNT" from moving. (FIG. 2).

Compensation for Gaps and Different Levels of Roofs

Spacers are used under "MODULAR MOUNT" to allow for the "MODULAR MOUNT" to be in a parallel position on the roof of the structure.

Fiber Embedded in Modular Mount:

One part of the MODULAR MOUNT (FIG. 2*a*) embeds the fire-resistant fabric to fix it to its needed position.

"Hanging Mechanism"

The "HANGING MECHANISM" (FIG. 2*b*) is a molded mounting fixture that is easy to install and made from the same high strength/high temperature material that the "MODULAR MOUNT" is made from. The anchoring function of the HANGING MECHNISM is claimed in this patent as a specifically designed and uniquely designed mechanism that has been fabricated in a modular fashion for the specific purpose of being able to hang the fire proof material.

The "HANGING MECHANISM" and the "MODULAR MOUNT" are both molded from a liquid or molten metal liquid. The materials used to achieve the final product are made from high temperature materials that WILL NOT BURN below 800° C. (Celsius) and 2000° F. (Fahrenheit) for the specific materials. The material used will not burn due to the fact that fire burns at a relative worst case approximately 1600 deg. F. The materials used in this design allow for a safety margin.

Antislip Mechanism

Designed and manufactured with the "MODULAR MOUNT" is a specifically designed ANTISLIP mechanism.

References

The "ESFPS" does not infringe on any other patents as a complete concept and design, it utilizes much of existing materials.

Examples of Some Materials Used but not Limited to 3M 312-fiberglass fireproof cloth material
Aremco Composite materials
Standard Aluminum and cast aluminum
Standard Steel type materials

DESCRIPTION OF RELATED ART

Figure 1A:
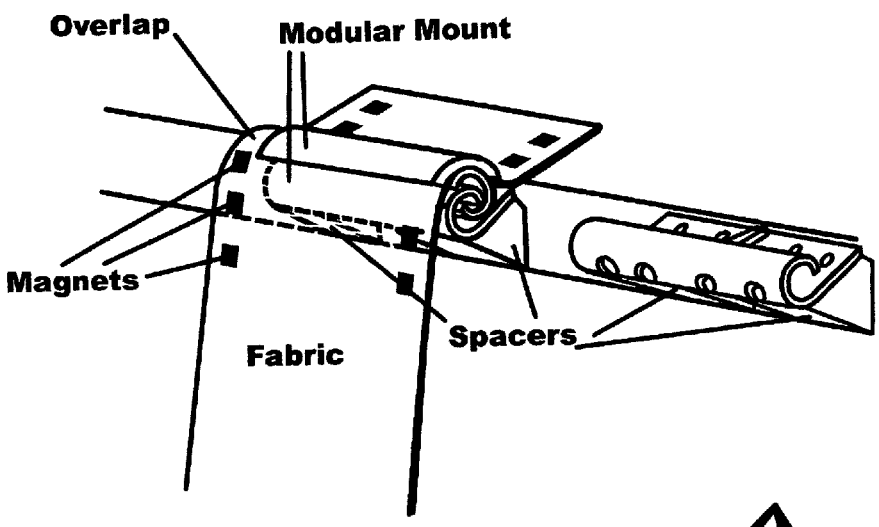
FIG. 1 Assembly drawing of "ESFPS"
FIG. 2 Detailed parts drawings
FIG. 3 Magnetic/Fabric Connection
Figure 1B:
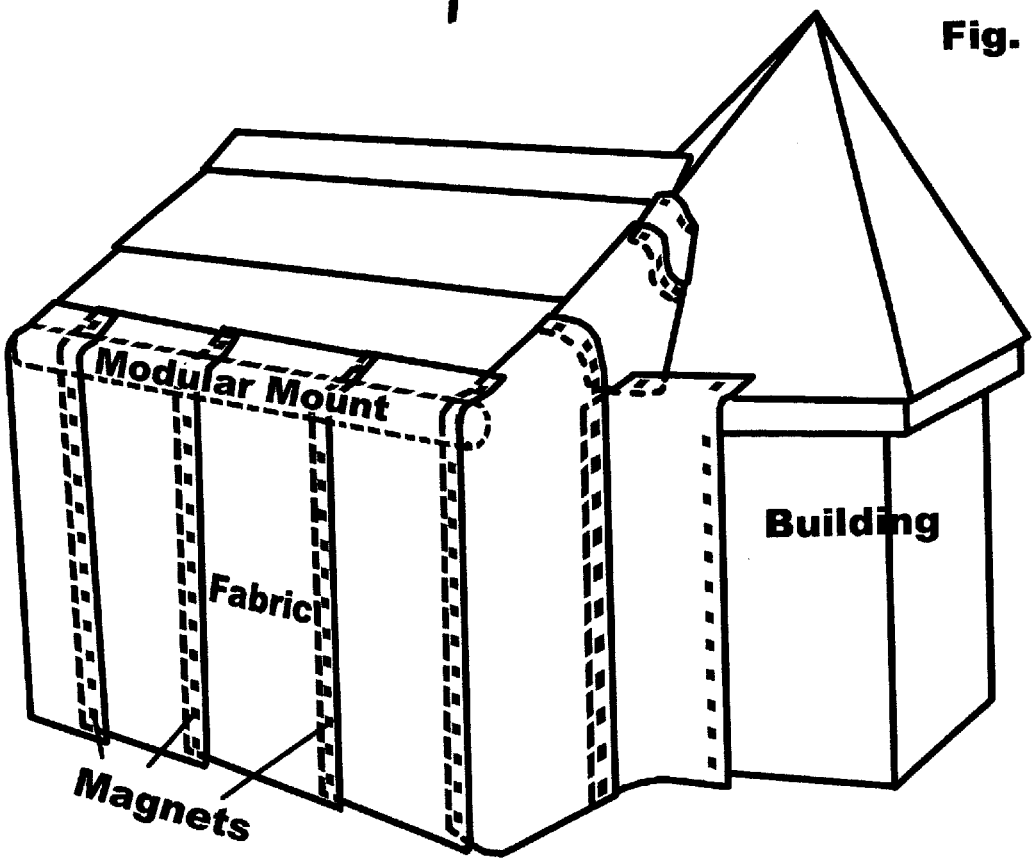
Figure 3:
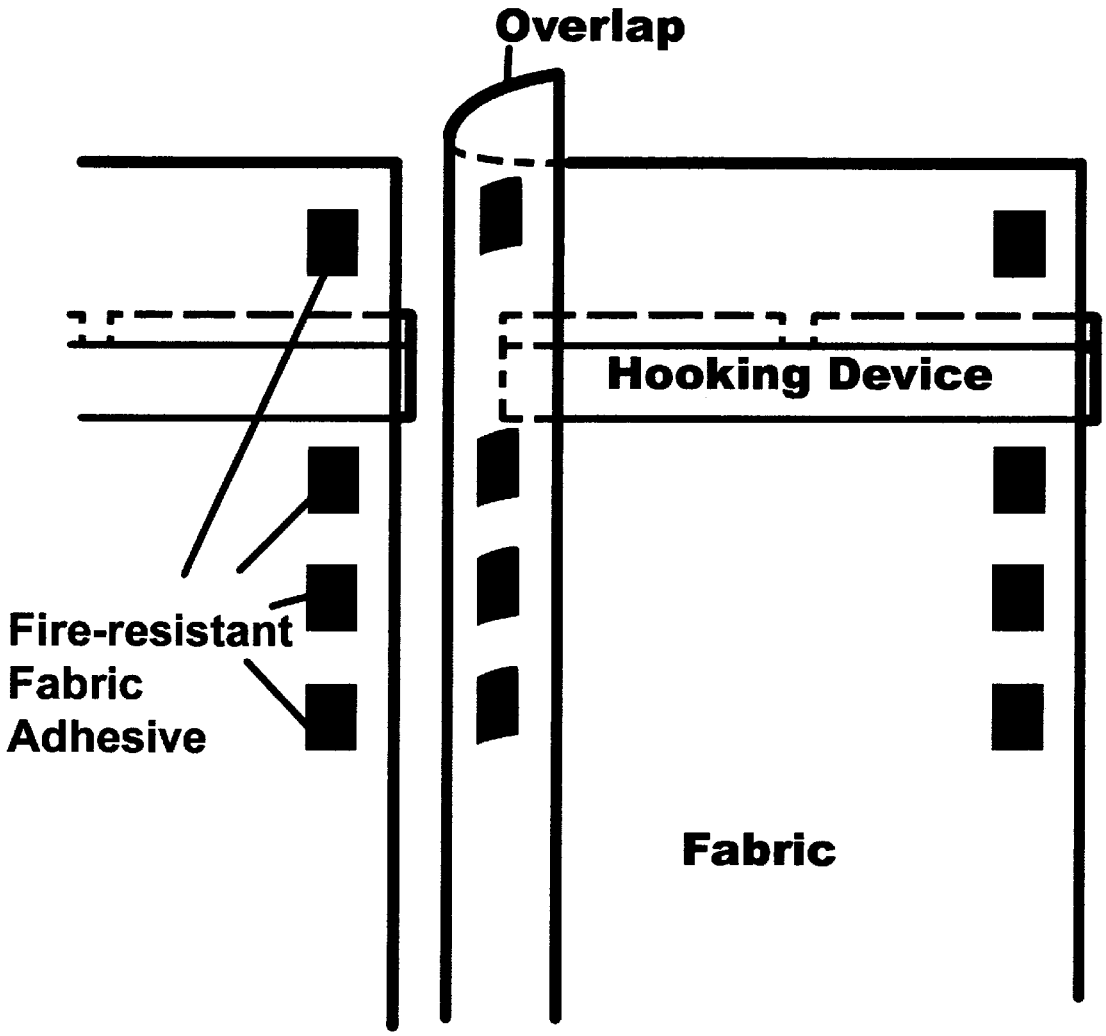

FIG. 1*a,b* Completed Assembly drawing
FIGS. 2*a,b* Detailed Assembly Drawing
FIG. 3 Fire resistant fabric adhesive Connection

We claim:

1. A fire barrier system for a building, the fire barrier system comprising:

a plurality of fire resistant modular mounts comprising materials that will not burn below 2000° F., each modular mount comprising a modular mount hook panel and a C-shaped modular mount hanging component, wherein said modular mount hook panels are 4, 5, or 6 feet in length and comprise a lengthwise curl for hooking and holding said C-shaped modular mount hanging components;

a plurality of spacers, for being mounted to the building, mounted below the modular mounts; and a plurality of fire resistant fabric panels comprising magnets and adhesive for attaching adjacent fire resistant fabric panels, wherein said fire resistant fabric panels comprise end portions embedded in said C-shaped modular mount hanging components and wherein said fire resistant fabric panels overlap said C-shaped modular mount hanging components.

2. The fire barrier system of claim 1, further comprising a water sprinkler system.

3. The fire barrier system of claim 1, wherein said adhesive is sewn into said fire resistant fabric panels.

4. The fire barrier system of claim 1, wherein said modular mount hook panels comprise ceramic, aluminum alloy, or steel.

5. The fire barrier system of claim 1, wherein said C-shaped modular mount hanging components comprise ceramic, aluminum alloy, or steel.

6. The fire barrier system of claim 1, wherein said modular mounts are capable of supporting 3 times their weight.

7. The fire barrier system of claim 1, wherein said modular mount hook panels are molded.

8. The fire barrier system of claim 1, wherein said C-shaped modular mount hanging components are molded.

9. The fire barrier system of claim 1, wherein said fire resistant fabric panels comprise fiberglass.

* * * * *